US009662261B2

(12) United States Patent
Julin et al.

(10) Patent No.: US 9,662,261 B2
(45) Date of Patent: May 30, 2017

(54) FAIL-SAFE SYSTEM FOR EXOSKELETON JOINTS

(71) Applicant: Ekso Bionics, Inc., Richmond, CA (US)

(72) Inventors: Aaron Julin, Oakland, CA (US); Reuben Sandler, Berkeley, CA (US); Tom Smith, Rodeo, CA (US); Adam Zoss, Berkeley, CA (US)

(73) Assignee: Ekso Bionics, Inc., Richmond, CA (US)

( * ) Notice: Subject to any disclaimer, the term of this patent is extended or adjusted under 35 U.S.C. 154(b) by 557 days.

(21) Appl. No.: 14/157,052

(22) Filed: Jan. 16, 2014

(65) Prior Publication Data

US 2014/0200491 A1 Jul. 17, 2014

Related U.S. Application Data

(60) Provisional application No. 61/753,243, filed on Jan. 16, 2013.

(51) Int. Cl.
*A61H 3/00* (2006.01)
*A61H 1/02* (2006.01)

(52) U.S. Cl.
CPC ..... *A61H 3/00* (2013.01); *A61H 1/0262* (2013.01); *A61H 2201/0173* (2013.01); *A61H 2201/163* (2013.01); *A61H 2201/165* (2013.01); *A61H 2201/1616* (2013.01); *A61H 2201/1642* (2013.01); *A61H 2201/50* (2013.01)

(58) Field of Classification Search
CPC ..... A61H 3/00; A61H 1/0262; A61H 2201/1642; A61H 2201/165; A61H 2201/0173; A61H 2201/1616; A61H 2201/163; A61H 2201/50; A61H 1/0237; A61H 1/024; A61H 2201/5023; A61H 2201/2025; A61H 2201/5035; A61H 2201/5041; A61H 2201/0176; A61H 2203/00; A61H 2203/04;
(Continued)

(56) References Cited

U.S. PATENT DOCUMENTS 4,252,111 A 2/1981 Chao et al.
4,697,808 A 10/1987 Larson et al.
(Continued)

*Primary Examiner* — Quang D Thanh
(74) *Attorney, Agent, or Firm* — Diederiks & Whitelaw, PLC

(57) ABSTRACT

An orthotic system includes a controller, a joint and a fail-safe system for the joint. In a preferred embodiment, the orthotic system is an exoskeleton, the joint is a knee joint and the fail-safe system is a normally engaged brake that is controlled by the controller. The brake is engaged when the controller fails or the exoskeleton is powered off. The exoskeleton also includes an electrical or mechanical brake disengagement mechanism, separate from the controller, so that an exoskeleton user can disengage the brake when desired. The exoskeleton can also include an override mechanism that prevents the brake disengagement mechanism from functioning when the exoskeleton is powered on and the controller has not failed. Additionally, the exoskeleton can include a user interface at one location, with the brake disengagement mechanism located at a different, limited access location, so that the user cannot accidentally activate the brake disengagement mechanism.

13 Claims, 4 Drawing Sheets

(58) Field of Classification Search
CPC ..... A61H 2203/0406; A61H 2205/10; A61H 2205/102; A61H 2205/104; A61H 2205/106; A61H 2205/108; A61F 5/0102; A61F 5/0106; A61F 5/0123; A61F 2005/0155; A61F 2005/0158; A61F 2005/016; A61F 2005/0162
See application file for complete search history.

(56) References Cited

U.S. PATENT DOCUMENTS

| | | | | |
|---|---|---|---|---|
| 4,934,694 | A * | 6/1990 | McIntosh | B23P 19/066 482/137 |
| 5,490,831 | A * | 2/1996 | Myers | A61F 5/0102 602/16 |
| 5,630,791 | A | 5/1997 | Glynn | |
| 5,728,164 | A | 3/1998 | Ferrari et al. | |
| 6,296,595 | B1 | 10/2001 | Stark et al. | |
| 6,500,138 | B1 * | 12/2002 | Irby | A61F 5/0125 602/26 |
| 6,635,024 | B2 | 10/2003 | Hatton et al. | |
| 6,979,304 | B2 | 12/2005 | Nijenbanning et al. | |
| 7,722,555 | B2 | 5/2010 | Doty et al. | |
| 7,998,096 | B1 | 8/2011 | Skoog | |
| 2008/0039756 | A1 * | 2/2008 | Thorsteinsson | A61B 5/1038 602/23 |
| 2008/0255489 | A1 | 10/2008 | Genda et al. | |
| 2013/0197408 | A1 * | 8/2013 | Goldfarb | A61F 5/0102 601/35 |
| 2015/0351995 | A1 * | 12/2015 | Zoss | A61H 1/024 623/32 |

* cited by examiner

FAIL-SAFE SYSTEM FOR EXOSKELETON JOINTS

CROSS REFERENCE TO RELATED APPLICATIONS

The present application claims the benefit of U.S. Provisional Patent Application Ser. No. 61/753,243 entitled "Fail-safe Joints for Powered Orthotic Systems" filed Jan. 16, 2013. The entire content of this application is incorporated herein by reference.

BACKGROUND OF THE INVENTION

The present invention pertains to powered orthotic systems and, more particularly, to fail-safe joints for powered orthotic systems.

Orthotic systems, such as human exoskeleton devices, are being used to restore, rehabilitate, enhance and protect human muscle function. These exoskeleton devices are systems of motorized braces that apply forces to the appendages of an exoskeleton user. In order to enhance exoskeleton device safety, exoskeleton devices often include a number of fail-safe systems (i.e., systems that fail in a safe state). One such fail-safe system is a normally engaged brake that is positioned in a joint between exoskeleton braces. These normally engaged brakes are used in exoskeleton joints in which a locked relative movement configuration is preferred over a free relative movement configuration during a failure.

The primary disadvantage of normally engaged brakes in exoskeleton devices is that the normally engaged brake prevents a user from adjusting the exoskeleton device without the use of active controls. Particularly during a control system failure, a normally engaged brake will lock the exoskeleton in its current position and prevent the user from adjusting the exoskeleton until the failure has been corrected and the control system resumes proper operation. Moreover, users cannot move the exoskeleton joints when the device is powered off, leading to great inconvenience during donning, doffing, sizing, transport and storage of the device even when there is no failure. With the above in mind, there is considered to be a need in the art for an exoskeleton device with a fail-safe system that eliminates or mitigates these problems by allowing a user to adjust the exoskeleton device during a control system failure or when the device is powered off.

SUMMARY OF THE INVENTION

The present invention is directed to an orthotic system including a controller, a joint and a fail-safe system for the joint. In a preferred embodiment, the orthotic system is an exoskeleton, the joint is a knee joint and the fail-safe system is a normally engaged brake that is controlled by the controller. The brake is engaged at least when the controller fails or the exoskeleton is powered off. The exoskeleton also includes an electrical or mechanical brake disengagement mechanism, separate from the controller, so that an exoskeleton user can disengage the brake when desired.

In a further preferred embodiment, the exoskeleton includes an override mechanism that prevents the brake disengagement mechanism from functioning when the exoskeleton is powered on and the controller has not failed. In a still further preferred embodiment, the exoskeleton includes a user interface at one location and the brake disengagement mechanism is located at a second location to avoid accidentally activating the brake disengagement mechanism. In one embodiment, the brake disengagement mechanism is located so that the user cannot reach the brake disengagement mechanism unaided unless the user is sitting.

Additional objects, features and advantages of the invention will become more readily apparent from the following detailed description of preferred embodiments thereof when taken in conjunction with the drawings wherein like reference numerals refer to common parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale; and some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
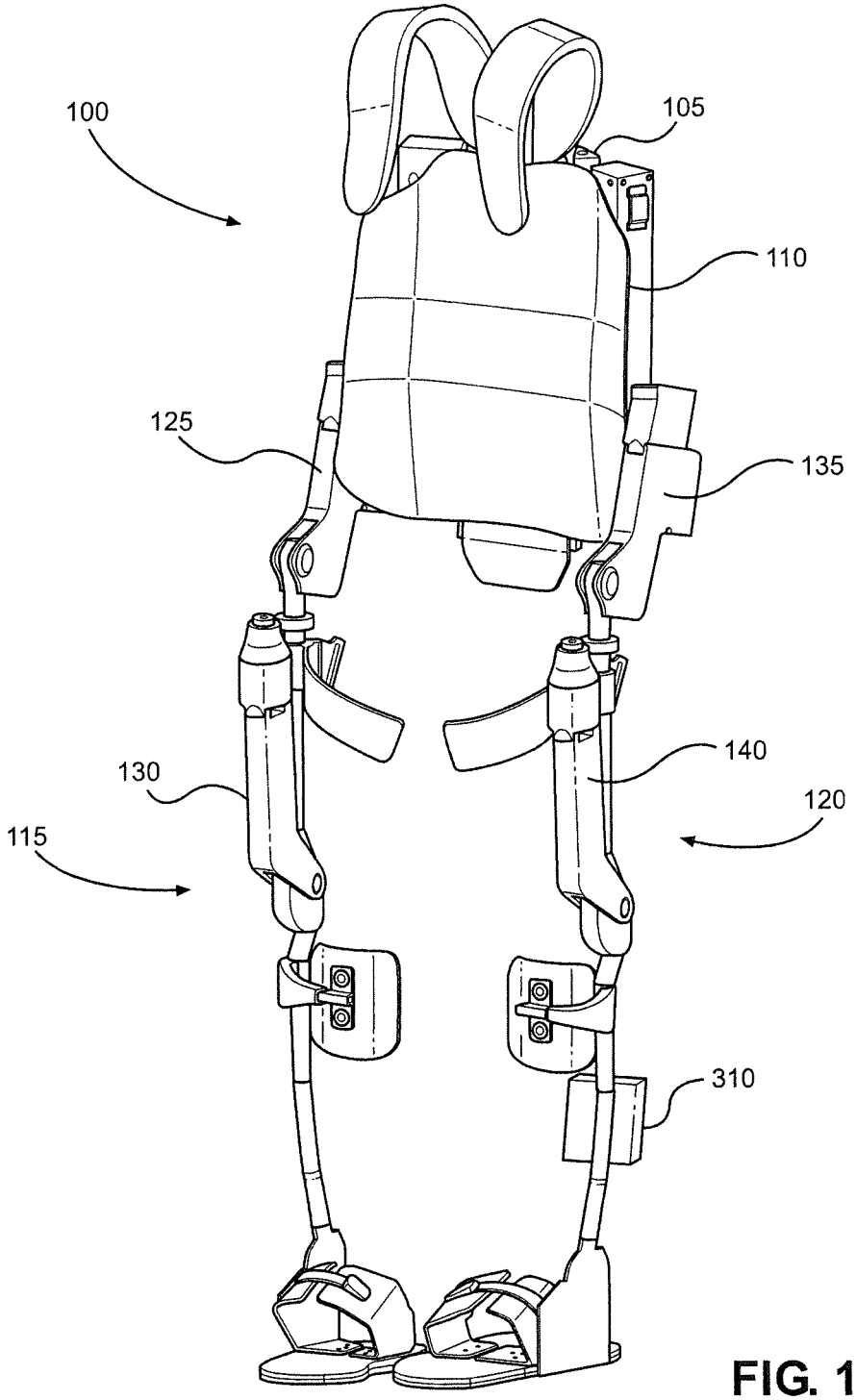
FIG. 1 is a perspective view of an exoskeleton device incorporating a fail-safe system in accordance with the present invention.

With initial reference to FIG. 1, there is shown a powered orthotic system in accordance with the present invention. Specifically, the powered orthotic system is in the form of an exoskeleton 100 that includes a controller 105 (or control system), a torso 110, a right leg 115 and a left leg 120. Right and left legs 115, 120 have actuated knees and hips. In particular, right leg 115 has a hip actuator 125 and a knee actuator 130, while left leg 120 has a hip actuator 135 and a knee actuator 140. In use, an exoskeleton user would wear exoskeleton 100 with torso 110 coupled to the user's torso, right leg 115 coupled to the user's right leg and left leg 120 coupled to the user's left leg. Controller 105 controls the motion of exoskeleton 100 through actuators 125, 130, 135 and 140 based on various signals received from sensors (not shown), as known in the art, so that the user is able to walk.

Exoskeleton 100 also includes normally engaged brakes (i.e., the brakes are engaged unless controller 105 causes the brakes to be disengaged) located in knee actuators 130 and 140 so that, in the event of a failure, such as a failure of controller 105, exoskeleton 100 will be locked in its current position. If the brakes were not locked during a failure, then a user without sufficient leg strength would likely fall as the knee joints could suddenly rotate freely. Although this discussion is directed to normally engaged, electronically disengaged brakes at both knee joints, it should be readily apparent that these concepts are applicable to all normally engaged brakes in orthotic systems. As discussed above, such a system typically has disadvantages. Specifically, the user can only adjust the exoskeleton using active controls and is therefore unable to adjust the exoskeleton during a failure or when the exoskeleton is powered off. In contrast, exoskeleton 100 is designed to eliminate or mitigate these disadvantages.

Figure 2A:
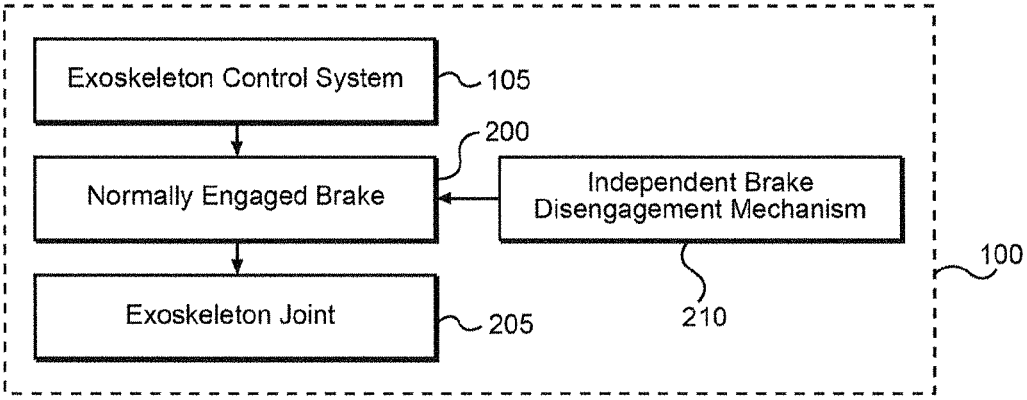
FIG. 2A schematically illustrates the exoskeleton device in accordance with a first embodiment of the present invention.
Figure 2B:
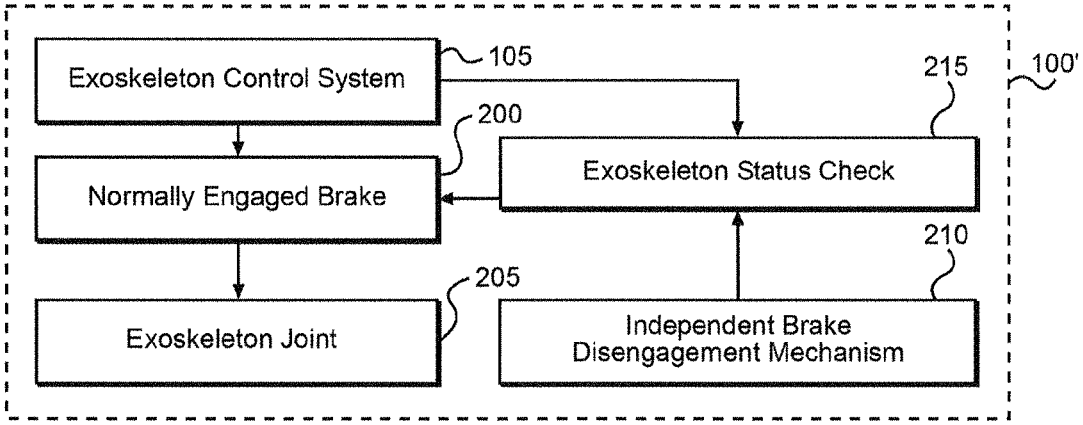
FIG. 2B schematically illustrates a modified form of the exoskeleton device in accordance with a second embodiment of the present invention.

FIG. 2A shows a first embodiment of the present invention with controller 105, at least one normally engaged brake 200, at least one exoskeleton joint 205 (e.g., a knee joint in right leg 115 or left leg 120) and an independent brake disengagement mechanism 210. With the inclusion of independent brake disengagement mechanism 210, a user of exoskeleton 100 can disengage brake 200 when desired without going through controller 105, which is beneficial during a failure of controller 105 or when exoskeleton 100 is powered off and the user is putting on or taking off exoskeleton 100, for example. While this embodiment represents an improvement over the prior art, one disadvantage of this approach is that independent brake disengagement mechanism 210 can interfere with controller 105 when controller 105 has not failed. Accordingly, a second embodiment, shown in FIG. 2B, further includes a status check 215. As a result, when controller 105 has not failed, as determined by status check 215, an override mechanism is employed to prevent independent brake disengagement mechanism 210 from functioning. One skilled in the art of motion control systems can appreciate that there are many methods of checking the status of controller 105, including watchdog timers and handshaking communications.

Figure 3A:
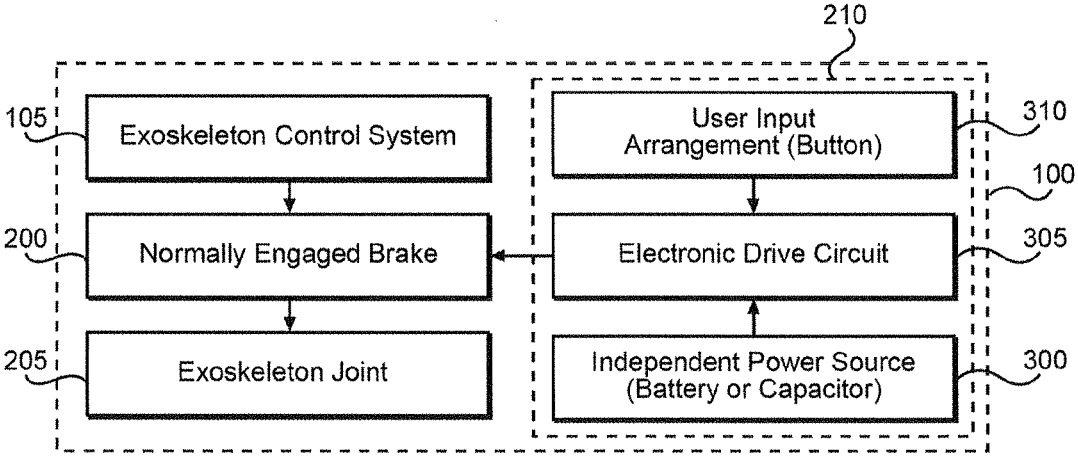
FIG. 3A is a schematic view of the exoskeleton device of the first embodiment with an electrical brake disengagement mechanism.
Figure 3B:
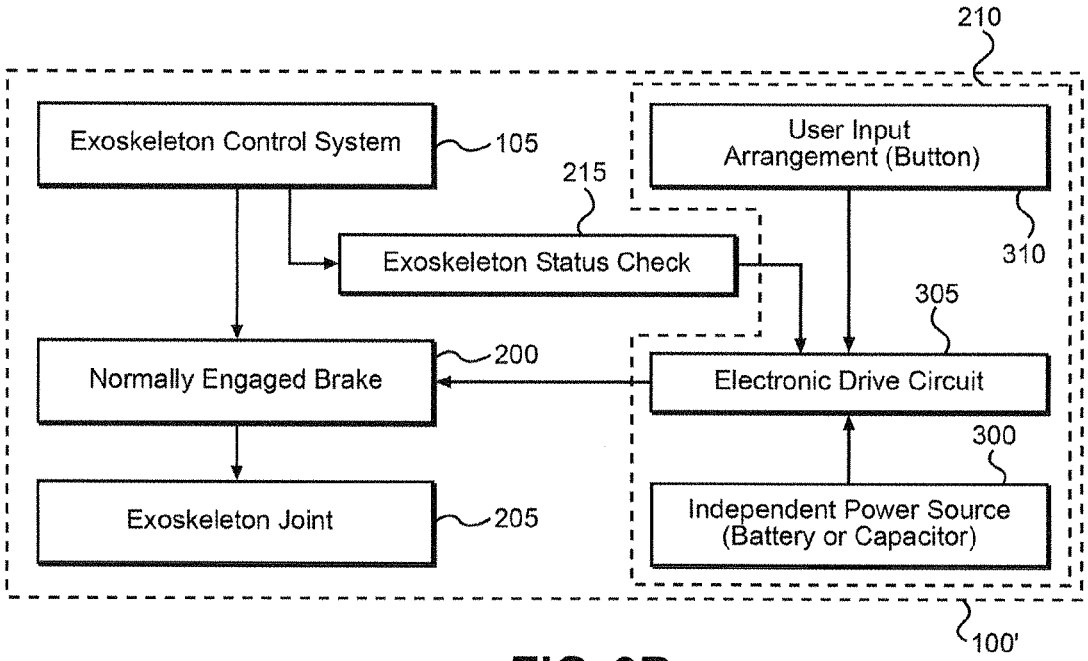
FIG. 3B is a schematic view of the exoskeleton device of the second embodiment with the electrical brake disengagement mechanism.

In general, independent disengagement of a brake is accomplished in two different ways: through an electrical solution and through a mechanical solution. A first electrical solution is shown in FIG. 3A and includes an independent power source 300, such as a battery or a capacitor; an electronic drive circuit 305 that converts an output from independent power source 300 into a signal suitable for brake disengagement; and a user input arrangement 310, such as a button, that activates drive circuit 305. As a result, a user of exoskeleton 100 is able to interact with user input arrangement 310, by pressing a button for example, in order to disengage normally engaged brake 200. A second electrical solution is shown in FIG. 3B that includes status check 215, as in the embodiment shown in FIG. 2B. Therefore, as described above, drive circuit 305 is only activated under defined exoskeleton statuses, such as during a failure of exoskeleton 100. In one preferred embodiment, user input arrangement 310 is located such that it will not accidentally be activated by the user (i.e., it is not located on the normal or primary user interface). In one example, user input arrangement 310 is located such that the user cannot reach it unless the user is seated, such as by positioning user input arrangement 310 below a level of the knee joints (as represented in FIG. 1). As a result, there is little risk of user injury due to intentional or unintentional activation of user input arrangement 310.

Figure 4:
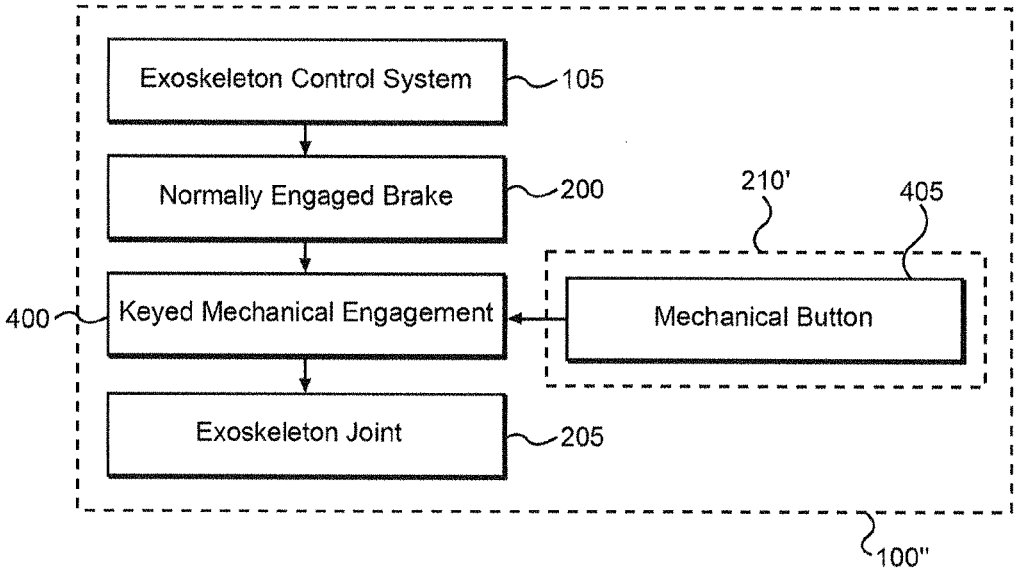
FIG. 4 is a schematic view of the exoskeleton device with a mechanical brake disengagement mechanism.
Figure 5:
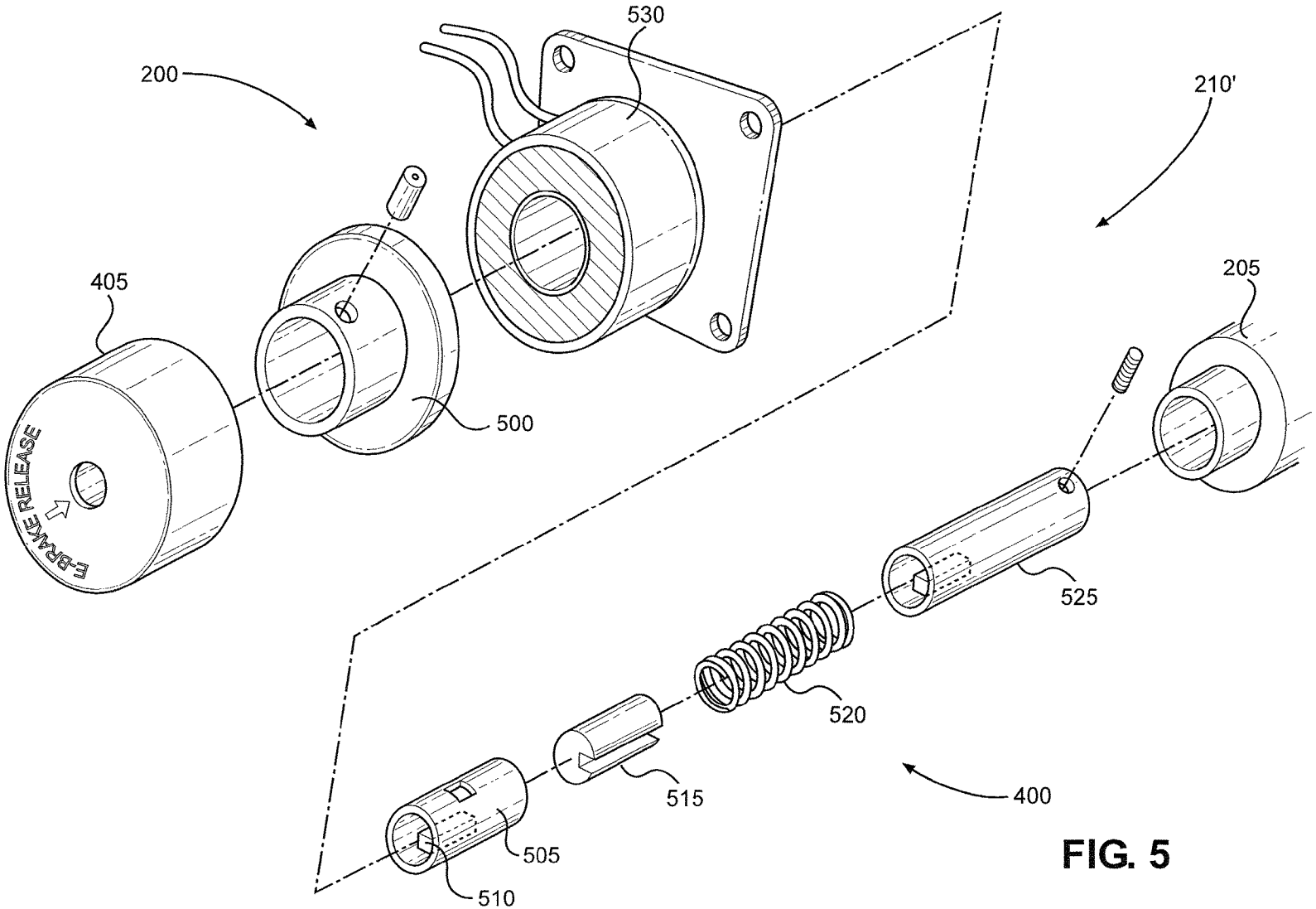
FIG. 5 is an exploded view of one embodiment of the mechanical brake disengagement mechanism.

A mechanical solution for independent brake disengagement is schematically represented in FIG. 4. Here, normally engaged brake 200 includes an armature and hub brake assembly that transfers torque into a driveshaft (not shown in FIG. 4). The driveshaft includes a keyed mechanical engagement 400 to exoskeleton joint 205 and a mechanical button, lever, rotary knob or the like 405 is provided, which acts to disengage keyed mechanical engagement 400. A more detailed view of a preferred embodiment of the mechanical solution of FIG. 4 is shown in FIG. 5. In this embodiment, an armature 500, of normally engaged brake 200, is couple to a hollow driveshaft 505. Driveshaft 505 includes a mechanical key 510 that engages a keyed insert 515 using a spring 520. Keyed insert 515 is disengaged from mechanical key 510 by a user pressing mechanical button 405 to counteract spring 520, with keyed insert 515 being coupled to an outer collar 525 that transmits torque to exoskeleton joint 205. In this embodiment, brake hub 530 is coupled to the structure of exoskeleton 100. By depressing button 405, the user can disengage keyed insert 515 from driveshaft 505, effectively releasing brake 200 (i.e., armature 500 and hub 530) and overriding controller 105. Upon releasing button 405, the user allows controller 105 to once again control joint 205. In one preferred embodiment, similar to that described in connection with the electrical solutions, button 405 is located so that the user can only reach button 405 when the user assumes one or more predetermined positions, for example only when the user is seated.

Based on the above, it should be readily apparent that the present invention provides for an exoskeleton device with a fail-safe system that eliminates or mitigates the problems of the prior art by allowing a user to adjust the exoskeleton device during a control system failure or when the device is powered off. Although described with reference to preferred embodiments, it should be readily understood that various changes or modifications could be made to the invention without departing from the spirit thereof. For example, the present invention is usable in a broad range of orthotic systems and in connection with any joint having a normally engaged brake. In general, the invention is only intended to be limited by the scope of the following claims.

The invention claimed is:

1. An exoskeleton comprising:

a controller;

a joint;

a fail-safe system for the joint, the fail-safe system including a normally engaged brake that is controlled by the controller, wherein the fail-safe system is configured so that the brake is engaged at least when the controller fails or the exoskeleton is powered off; and a brake disengagement mechanism, separate from the controller, wherein a user of the exoskeleton can disengage the brake, by selectively activating the brake disengagement mechanism, at least when the controller fails or the exoskeleton is powered off.

2. The exoskeleton of claim 1, wherein the brake disengagement mechanism is an electrical or mechanical mechanism.

3. The exoskeleton of claim 2, wherein the joint constitutes a knee joint.

4. The exoskeleton of claim 3, further comprising:

an override mechanism, wherein the brake disengagement mechanism is prevented from functioning by the override mechanism when the exoskeleton is powered on and the controller has not failed.

5. The exoskeleton of claim 3, further comprising a primary user interface in a first location, wherein the brake disengagement mechanism is located in a second location that is different from the first location.

6. The exoskeleton of claim 5, wherein the brake disengagement mechanism is located such that the user cannot reach the brake disengagement mechanism unaided unless the user is sitting.

7. An orthotic system comprising:

a controller;

a joint, wherein the orthotic system is an exoskeleton and the joint constitutes a knee joint;

a fail-safe system for the joint, the fail-safe system being controlled by the controller, wherein the fail-safe system is engaged at least when the controller fails or the orthotic system is powered off, and wherein the fail-safe system includes a normally engaged brake; and a fail-safe disengagement mechanism, separate from the controller, wherein a user of the orthotic system can disengage the fail-safe system, by activating the fail-safe disengagement mechanism, at least when the controller fails or the orthotic system is powered off, wherein the fail-safe disengagement mechanism disengages the normally engaged brake when the fail-safe disengagement mechanism is activated, and wherein the fail-safe disengagement mechanism is electrical or mechanical.

8. The orthotic system of claim 7, further comprising:

an override mechanism, wherein the fail-safe disengagement mechanism is prevented from functioning by the override mechanism when the orthotic system is powered on and the controller has not failed.

9. The orthotic system of claim 7, further comprising a primary user interface in a first location, wherein the fail-safe disengagement mechanism is located in a second location that is different from the first location.

10. The orthotic system of claim 9, wherein the fail-safe disengagement mechanism is located such that the user cannot reach the fail-safe disengagement mechanism unaided unless the user is sitting.

11. A method for operating a fail-safe system in an orthotic system including a controller and at least one joint, the method comprising:

engaging the fail-safe system when the controller fails or the orthotic system is powered off;

disengaging the fail-safe system when a fail-safe disengagement mechanism is activated, wherein engaging the fail-safe system includes engaging a brake and disengaging the fail-safe system includes disengaging the brake; and preventing the fail-safe system from being disengaged when the orthotic system is powered on and the controller has not failed.

12. The method of claim 11, wherein the orthotic system further includes a primary user interface in a first location, said method further comprising:

activating the fail-safe disengagement mechanism from a second location that is different from the first location.

13. The method of claim 12, wherein activating the fail-safe disengagement mechanism from a second location includes enabling a user to reach the fail-safe disengagement mechanism unaided only when the user is sitting.

* * * * *